US008074769B2

(12) United States Patent
Sracic et al.

(10) Patent No.: US 8,074,769 B2
(45) Date of Patent: Dec. 13, 2011

(54) LADDER ACCESSORY

(75) Inventors: Michael W. Sracic, Madison, WI (US); Daniel J. Goesch, Colgate, WI (US); Logan J. Hamel, Northglenn, CO (US); Elliot J. Haag, Madison, WI (US); David J. Tengler, Delafield, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 867 days.

(21) Appl. No.: 11/847,926

(22) Filed: Aug. 30, 2007

(65) Prior Publication Data

US 2009/0057057 A1 Mar. 5, 2009

(51) Int. Cl.
*E06C 7/16* (2006.01)

(52) U.S. Cl. ..... 182/103; 182/101; 182/102; 182/115; 182/129

(58) Field of Classification Search ..... 182/101, 182/102, 103, 115, 116, 129
See application file for complete search history.

(56) References Cited

U.S. PATENT DOCUMENTS 651,665 A * 6/1900 Johns ..... 182/103
1,969,628 A * 8/1934 Skeenes ..... 182/14
2,438,791 A * 3/1948 Alberta ..... 182/103
2,838,342 A * 6/1958 Masse ..... 248/238
3,115,211 A * 12/1963 Ostrander, Jr. ..... 182/103
3,428,145 A * 2/1969 Lyon ..... 182/103
3,666,054 A * 5/1972 Ellings et al. ..... 182/103
4,546,853 A * 10/1985 Hanson ..... 182/103
4,646,878 A * 3/1987 Moyer ..... 182/121
5,275,256 A * 1/1994 Ellzey ..... 182/103
5,507,363 A * 4/1996 Tredup ..... 182/129
6,244,381 B1 * 6/2001 Ruble ..... 182/103
7,004,288 B2 * 2/2006 Araki et al. ..... 182/103

* cited by examiner

*Primary Examiner* — Alvin Chin Shue
*Assistant Examiner* — Colleen M Quinn
(74) *Attorney, Agent, or Firm* — Boyle Fredrickson, S.C.

(57) ABSTRACT

A device is provided for aiding a user in transporting a load up and down a ladder assembly. The ladder assembly includes a fly ladder having slidably connected to a base ladder. Each ladder includes first and second spaced rails interconnected by a plurality of spaced rungs. The device has a frame assembly including a first subframe positionable adjacent the first rail of the base ladder and a second subframe positionable adjacent the second rail of the base ladder. First and second base ladder guides are operatively connected to each subframe and define tracks for receiving the rails of the base ladder therebetween. First and second fly ladder guides are operatively connected to the subframes and defines tracks for receiving the rails of the fly ladder therebetween.

21 Claims, 6 Drawing Sheets

FIG. 3
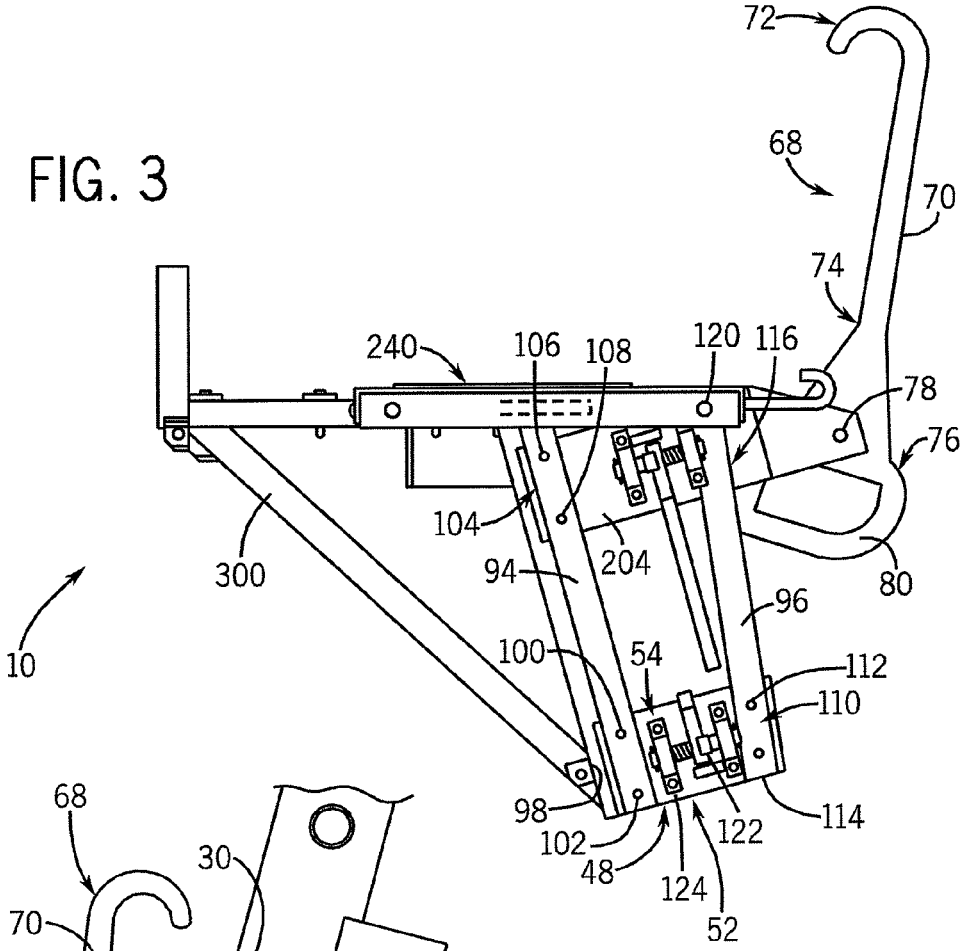
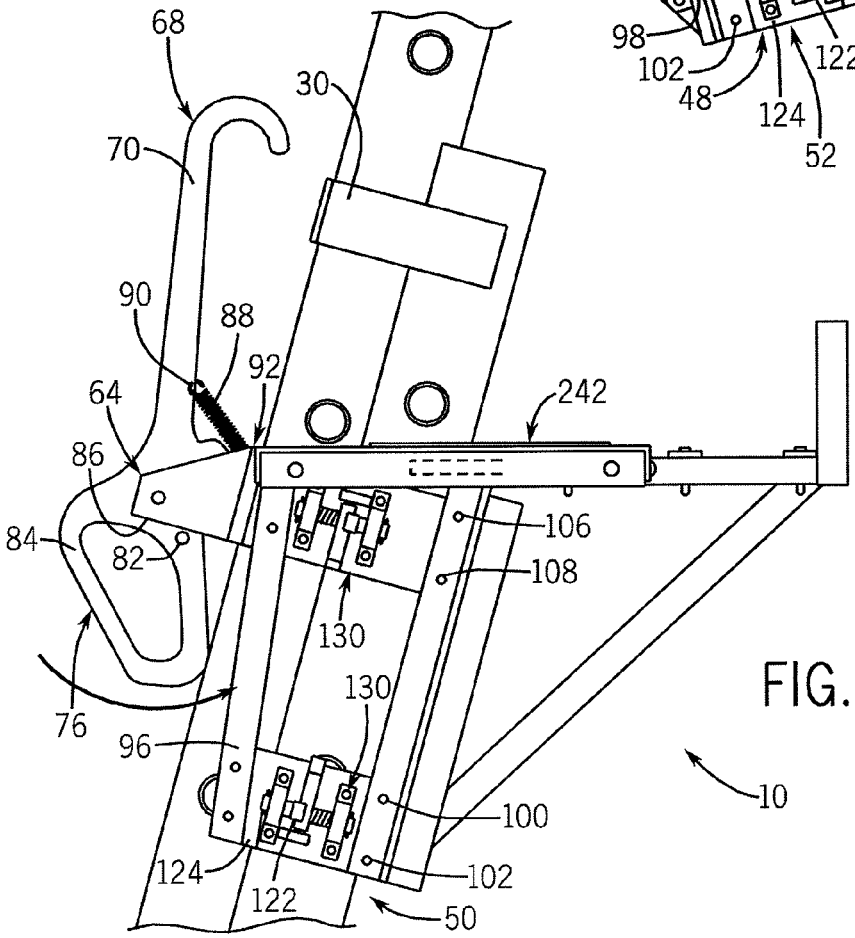
FIG. 4

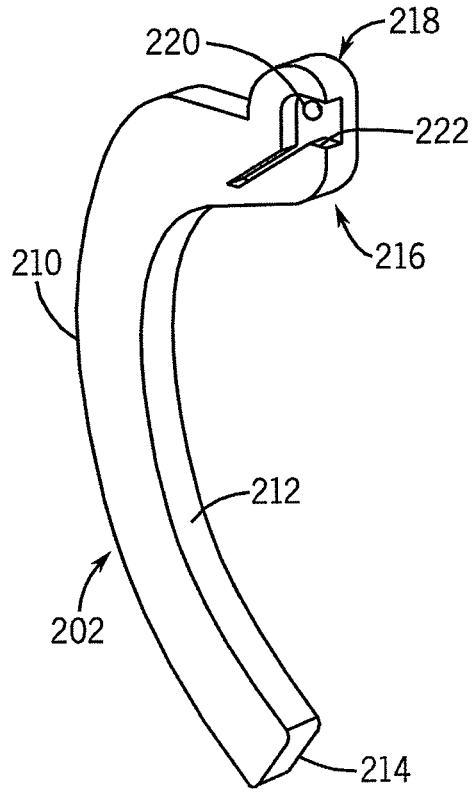
FIG. 10
FIG. 11
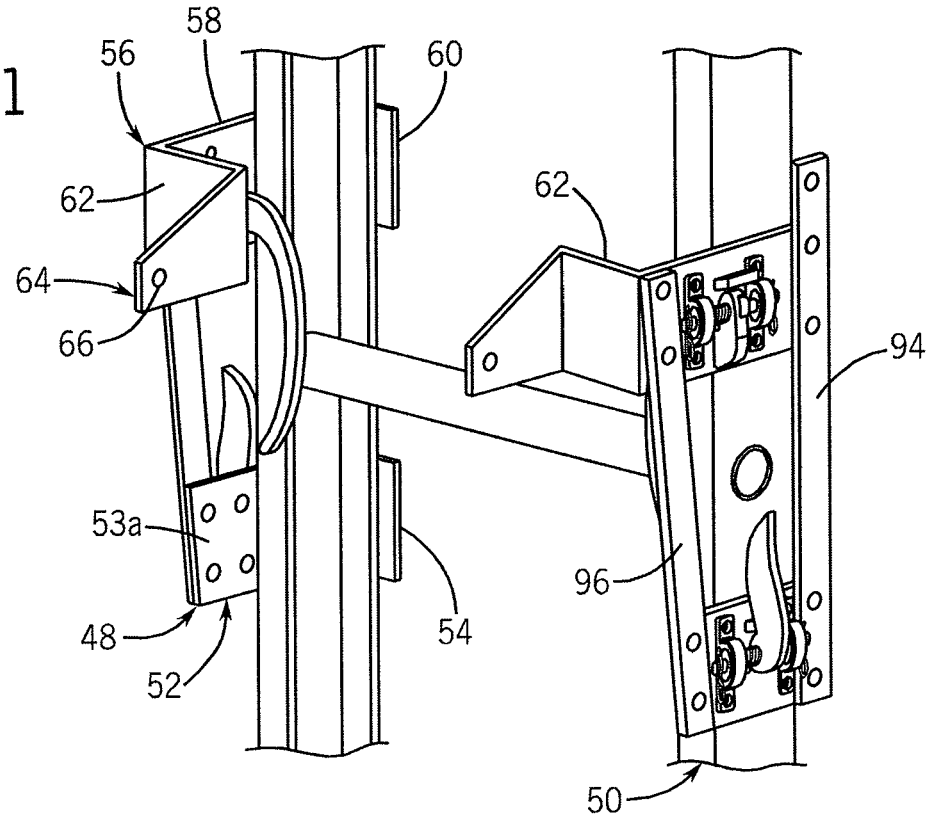

LADDER ACCESSORY

FIELD OF THE INVENTION

This invention relates generally to ladders, and in particular, to a ladder accessory that aids a user in the transport of a load up and down an extension ladder.

BACKGROUND AND SUMMARY OF THE INVENTION

Ladders have many uses in the construction industry including framing, house siding, painting, window installation, and roofing. As is known, there are variety of types of ladders designed for the specific project at hand. For example, extension ladders allow a user to research high locations. Typically, an extension ladder incorporates lower and upper telescoping sections. More specifically, the rails of the top or fly ladder are positioned between the rails of the lower or base ladder. Brackets at the upper ends of rails of the base ladder maintain the base and fly ladders together. A ratcheting device engages the rungs of the fixed ladder to prevent the fly ladder from sliding down the base ladder. As described, the sections of the extension ladder can be slid together for storage or slid apart to maximize the length of the ladder.

In order to allow a user the ability to carry loads up and down a ladder, various devices have been developed. By way of example, British Patent No. 2,420,819 discloses a manual hoist for use with a ladder. The hoist includes a slidably displaceable member having a means for supporting a load to be elevated. More specifically, the displaceable member includes a plate assembly which surrounds the ladder and has rollers which bear against the stiles. A selectively releasable locking means is provided for locking the assembly against downward movement during a load lifting operation. The locking means includes a hook-like plate biased toward the rungs and a ring which is attached to a hoisting cable that which passes over an upper pulley and down to a winch fixedly attachable adjacent the base of the ladder. The device may carry the load either on the outside of the ladder or between the ladder and a building against which it leans.

While functional for its intended purpose, the hoist disclosed in the '819 patent is intended to be used with a straight ladder. Hence, the hoist in the '819 patent does not contemplate the various transfer points at the ends of the sections of an extension ladder. As a result, if used on an extension ladder, the hoist disclosed in the '819 patent is usable on only one of the sections thereof. Alternatively, gas-powered hoists are also available. Similar to manual hoists, the gas-powered hoists are intended to be used in connection with straight ladders and cannot be used in connection with extension ladders. Further, the cost of gas-powered hoists is significant.

Therefore, it is a primary object and feature of the present invention to provide a ladder accessory that aids a user in the transport of supplies up and down an extension ladder.

It is a further object and future of the present invention to provide a ladder accessory for aiding a user in the transport of supplies up and down an extension ladder that is simple to utilize and inexpensive to manufacture.

It is a further object and future of the present invention to provide a ladder accessory for aiding a user in the transport of supplies up and down an extension ladder that moves through the transition points of the base and fly ladders.

It is a still further object and future of the present invention to provide a ladder accessory for aiding a user in the transport of supplies up and down an extension ladder that allows a user to maintain at least three points of contact on an extension ladder through the ladder accessory at all times.

It is a still further object and future of the present invention to provide a ladder accessory for aiding a user in the transport of supplies up and down an extension ladder that automatically locks to the ladder and prevents unwanted downward movement of the load if the user loses his or her grip of the ladder accessory.

In accordance with the present invention, a device is provided for aiding a user in transporting a load up and down a ladder assembly. The ladder assembly includes a fly ladder slidably connected to a base ladder. Each ladder includes first and second spaced rails interconnected by a plurality of spaced rungs. The device includes a first base leg slideably engageable with a first side of the first rail of the base ladder and a second base leg slideably engageable with a second side of the first rail of the base ladder. A first fly leg is slideably engageable with a first side of the first rail of the fly ladder and a second fly leg is slideably engageable with a second side of the first rail of the fly ladder.

In accordance with a further aspect of the present invention, a device is provided for aiding a user in transporting a load up and down a ladder assembly. The ladder assembly includes a fly ladder slidably connected to a base ladder. Each ladder includes first and second spaced rails interconnected by a plurality of spaced rungs. The device includes a frame assembly having a first subframe positionable adjacent the first rail of the base ladder and a second subframe positionable adjacent the second rail of the base ladder. A first base leg and a first base arm are operatively connected to the first subframe and define a first track for receiving the first rail of the base ladder therebetween. A first fly leg and a first fly arm are also operatively connected to the first subframe and define a first track for receiving the first rail of the fly ladder therebetween.

In accordance with a still further aspect of the present invention, a device is provided for aiding a user in transporting a load up and down a ladder assembly. The ladder assembly includes a fly ladder slidably connected to a base ladder. Each ladder includes first and second spaced rails interconnected by a plurality of spaced rungs. The device includes a frame assembly having a first subframe positionable adjacent the first rail of the base ladder and a second subframe positionable adjacent the second rail of the base ladder. A first base leg and a first base arm are operatively connected to the first subframe and define a first track for receiving the first rail of the base ladder therebetween. A second base leg and a second base arm are operatively connected to the second subframe assembly and define a second track for receiving the second rail of the base ladder therebetween. A first fly leg and a first fly arm are operatively connected to the first subframe and define a first track for receiving the first rail of the fly ladder therebetween. A second fly leg and a second fly arm are operatively connected to the second subframe and define a second track for receiving the second rail of the fly ladder therebetween. A first rung lock mechanism is pivotably connected to the first subframe. The first rung lock mechanism is movable between a first disengaged position and a second engaged position wherein the first rung lock mechanism engages a user selected rung and prevents the frame assembly from sliding in a downward direction along the ladder assembly.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 3 is a first side view of the ladder accessory of the present invention;

FIG. 4 is a second side view of the ladder accessory of the present invention;

FIG. 10 is an isometric view of an upper support arm for the ladder accessory of the present invention;

FIG. 11 an isometric view of the ladder accessory of the present invention in a first position on the extension ladder of FIG. 1;

DETAILED DESCRIPTION OF THE DRAWINGS

Figure 1:
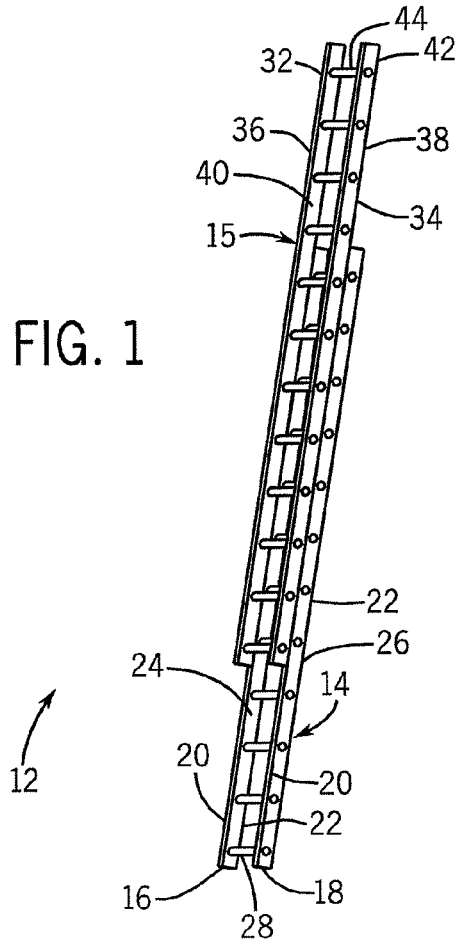
FIG. 1 is an isometric view of an extension ladder for use with the ladder accessory of the present invention.
Figure 2:
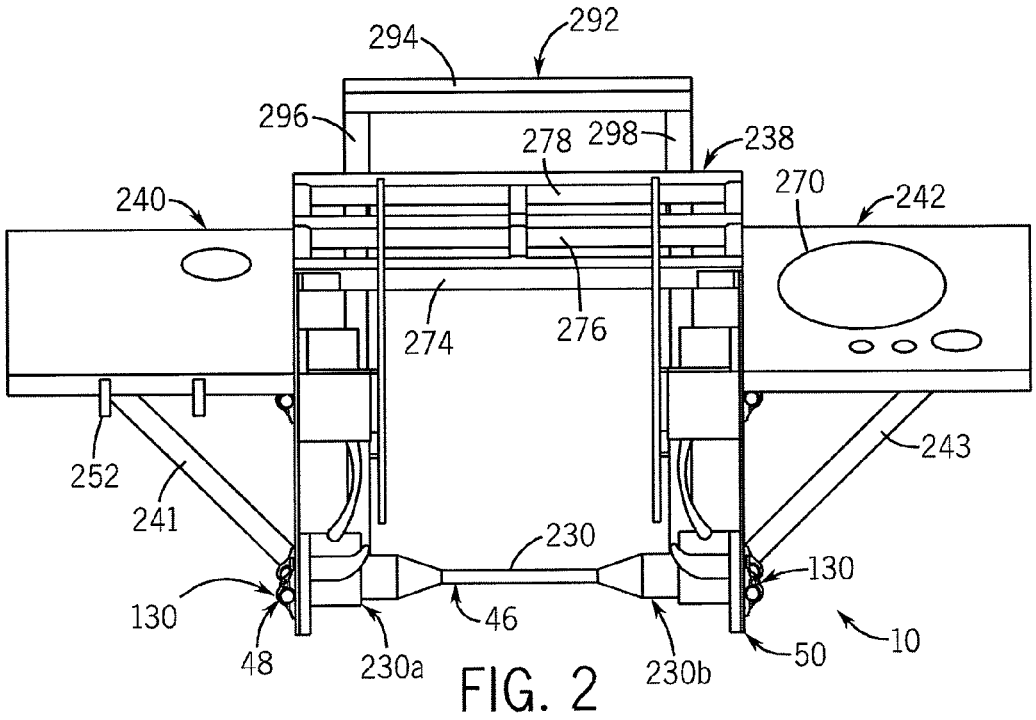
FIG. 2 is a front view of the ladder accessory of the present invention.

Referring to FIGS. 2-4, a ladder accessory in accordance with the present invention is generally designated by the reference numeral 10. It is intended for ladder accessory 10 to be used in connection with a conventional extension ladder, generally designated by the reference numeral 12, FIG. 1. Extension ladder 12 includes base ladder 14 and fly ladder 15 slidably connectable thereto in a telescoping arrangement. More specifically, base ladder 14 includes first and second generally parallel rails 16 and 18, respectively. Each rail 16 and 18 includes first and second sides 20 and 22, respectively, and inner and outer surfaces 24 and 26, respectively. Inner surfaces 24 of first and second rails 16 and 18, respectively, are interconnected by a plurality of vertically spaced rungs 28 that extend therebetween. As best seen FIG. 4, generally L-shaped brackets 30 are extended from outer surfaces 26 of first and second rails 16 and 18, respectively. Brackets 30 interconnect base ladder 14 and fly ladder 15 in a telescoping relationship.

Similar to base ladder 14, fly ladder 15 includes first and second generally parallel rails 32 and 34, respectively. Each rail 32 and 34 includes first and second sides 36 and 38, respectively. It can be appreciated that second sides 38 of first and second rails 32 and 34, respectively, of fly ladder 15 form a slidably interface with first sides 20 of first and second rails 16 and 18, respectively, base ladder 14. Rails 32 and 34 of fly ladder 15 includes inner surfaces 40 and outer surfaces 42. Inner surfaces 40 of rails 32 and 34 are interconnected by a plurality of horizontally rungs 44. As is conventional, fly ladder 15 includes a racketing device (not shown) that engages rungs 28 of base ladder 14 so as to prevent fly ladder 15 from sliding down base ladder 14. In addition, it is contemplated to brackets (not shown) at the lower ends of rails 36 and 38 of fly ladder 15. The brackets may be used to interconnect fly ladder 15 and base ladder 14 in a telescoping relationship.

Figure 7:
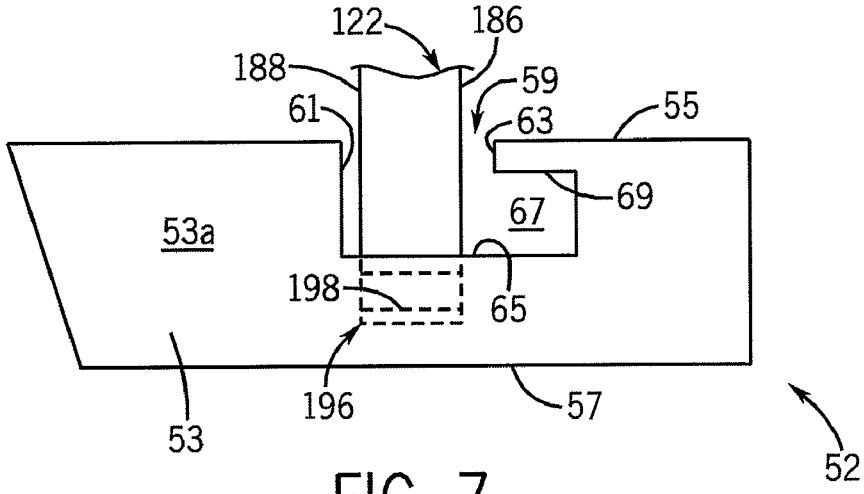
FIG. 7 is a schematic view of a lower support bracket for the ladder accessory of the present invention.
Figure 12:
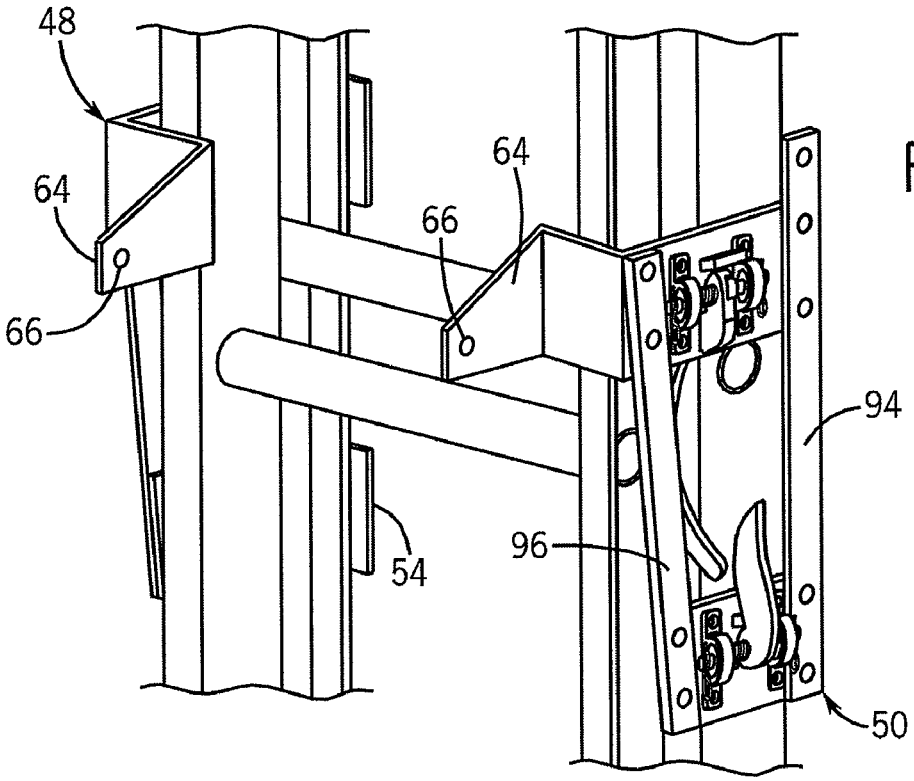
FIG. 12 is an isometric view of the ladder assembly of the present invention in a second position on the extension ladder of FIG. 1.
Figure 13:
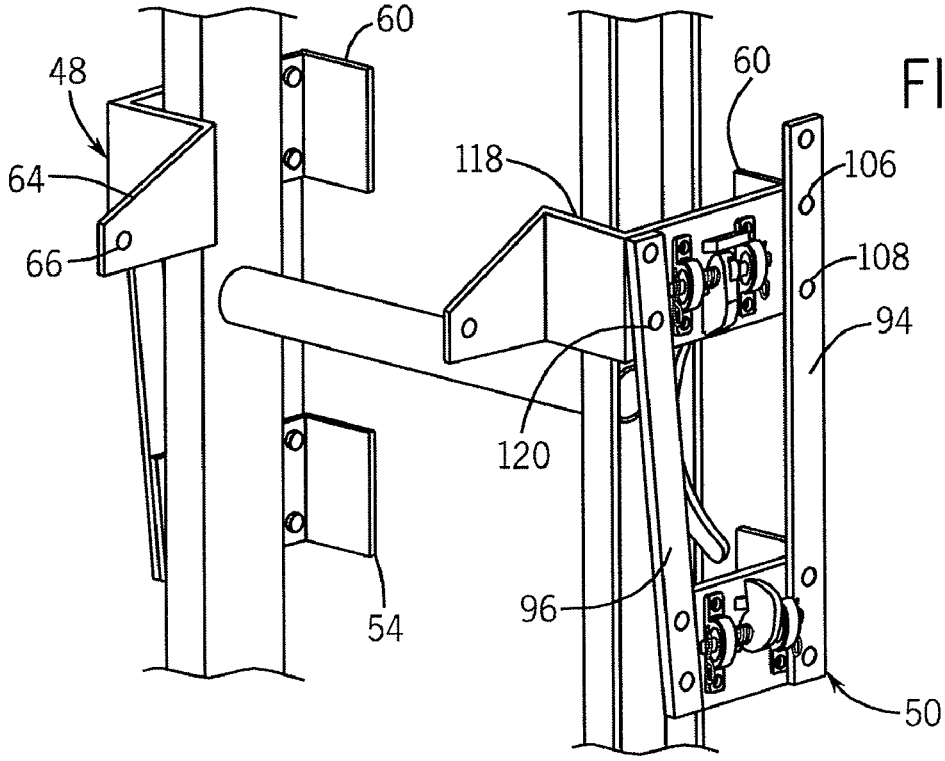
FIG. 13 is an isometric view of the ladder accessory of the present invention in a third position on the extension ladder of FIG. 1.

Ladder accessory 10 includes a frame assembly, generally designated by the reference numeral 46. As best seen in FIGS. 11-13, frame assembly 46 includes first and second subframes 48 and 50, respectively. Each subframe 48 and 50 is identical in structure, and as such, the following description of subframe 48 is understood to describe subframe 50, as if fully described hereinafter. Subframe 48 includes a generally L-shaped lower support bracket 52 having a first leg 53 with an inner surface 53*a* positionable adjacent the outer surfaces 26 and 42, respectively, of corresponding base and fly ladders 14 and 15, respectively, as hereinafter described. Referring to FIG. 7, first leg 53 is further defined by upper and lower edges 55 and 57, respectively. Upper edge 55 of first leg 53 of lower support bracket 52 includes slot 59 therein. Slot 59 is defined by first and second side edges 61 and 63, respectively, interconnected by lower edge 65. Notch 67 is formed in second side edge 63 of slot 59 and is defined by upper edge 69 and a portion of lower edge 65. Lower support bracket 52 further includes a second leg 54 generally perpendicular to and extending from first leg 53. Second leg 54 includes an inner surface 55, for reasons hereinafter described.

Referring to FIGS. 11-13 and 8, subframe 48 further includes a generally U-shaped upper support bracket 56. Upper support bracket 56 is defined by a base 58 having a first or base leg 60 and second or fly leg 62 projecting from opposite ends thereof. A generally triangular shaped mounting flange 64 projects from the terminal end of second leg 62 of upper mounting bracket 56. Flange 64 includes an aperture 66 therethrough for reasons hereinafter described. Base 58 is further defined by upper and lower edges 71 and 73, respectively. Lower edge 73 of base 58 of upper bracket 56 includes slot 75 therein. Slot 75 is defined by first and second side edges 77 and 79, respectively, interconnected by upper edge 81. Notch 83 is formed in second side edge 79 of slot 75 and is defined by lower edge 85 and a portion of upper edge 81.

As best seen in FIGS. 3 and 4, subframe 48 further includes a rung lock mechanism generally designated by the reference numeral 68. Rung lock mechanism includes an elongated shaft 70 having a hooked upper end 72 adapted for engaging a user selected rung 28 or 44 of corresponding base or fly ladder 14 and 15, respectively. Handle portion 76 is interconnected to lower end 74 of shaft 70 and is pivotably connected to mounting flange 64 by a pivot pin 78 extending from handle portion 76 into aperture 66 in mounting flange 64. Handle portion 76 of rung lock mechanism 68 includes an opening 80 therethrough for allowing a user to grasp handle portion 76 and pivot rung lock mechanism 68 about pivot pin 78. It can be appreciated that the shape and dimension of opening 80 can vary without deviating from the scope of the present invention. Handle portion 76 further includes a stop 82 projecting from outer surface of handle portion 76 of rung lock mechanism 68. Stop 82 engages lower edge 86 of mounting flange 64 and limits pivotable movement of rung lock mechanism 68 in a first direction. Rung lock mechanism 68 further includes spring 88 having a first end 90 operatively connected to shaft 70 of rung lock mechanism 68 and a second end 92 operatively connected to second leg 62 of upper bracket 56 so as to urge rung lock mechanism 68 in a second direction opposite to the first direction, heretofore described, toward a locking position.

Upper and lower brackets 56 and 52, respectively, are interconnected by first and second spaced frame elements 94 and 96, respectively. More specifically, lower end 98 of frame element 94 is interconnected to first leg 53 of lower bracket 52 in any suitable manner, such as by rivets 100 and 102. Similarly, upper end 104 of frame element 94 is interconnected to base 58 of upper bracket 56 in any suitable manner, such as by rivets 106 and 108. Likewise, lower end 110 of frame element 96 is connected to first leg 53 of lower bracket 54 in any suitable manner, such as by rivets 112 and 114. Upper end 116 of frame element 96 is interconnected to base 58 of upper bracket 56 in any suitable manner, such as by rivets 118 and 120.

Figure 6:
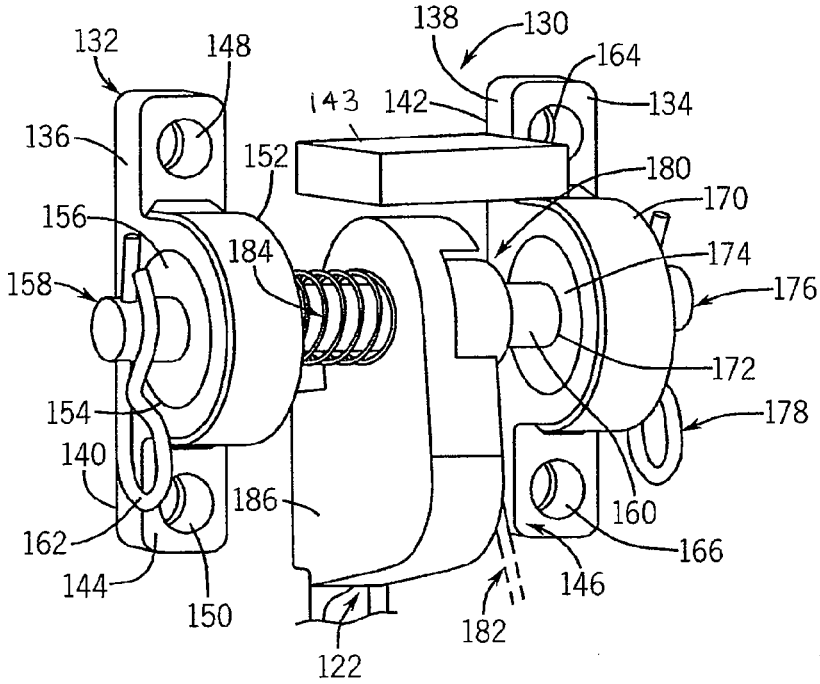
FIG. 6 is an enlarged isometric view of a collar mechanism of the ladder accessory of the present invention.
Figure 9:
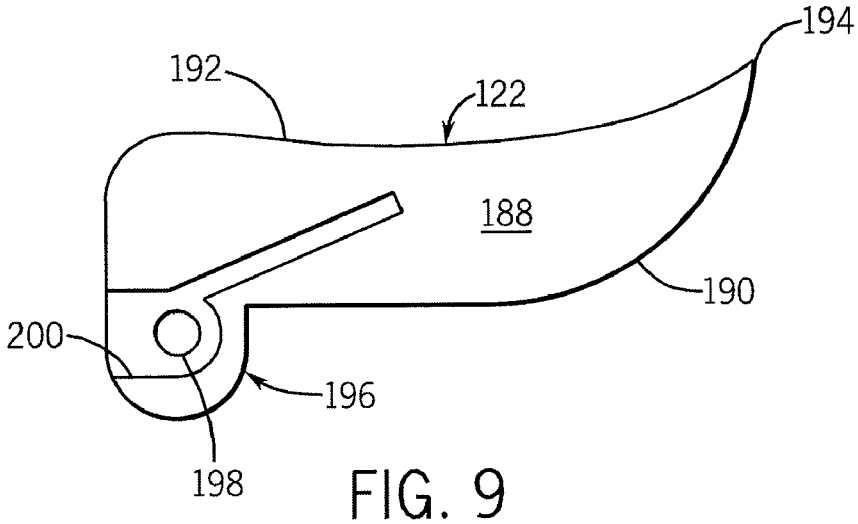
FIG. 9 is a side elevational view of a lower support arm for the ladder accessory of the present invention.

Lower support or fly arms 122 are pivotably connected to outer surfaces 124 of lower brackets 52 of first and second subframes 48 and 50, respectively, by a collar mechanism, generally designated by the reference numeral 130, FIG. 6. Referring to FIGS. 7 and 9, each support arm 122 is defined by first and second sides 186 and 188 interconnected by inner and outer edges 190 and 192, respectively. Inner and outer edges 190 and 192 intersect at first end 194 of lower arm 122. Eye 196 is positioned adjacent a second opposite end of lower support arm 122 and includes an aperture 198 thereto for receiving pivot pin 160, as hereinafter described. In addition, recess 200 is provided in second side 188 of lower support arm 122. Recess 200 communicates with aperture 198 through lower support arm 122 and with inner edge 190 of lower support arm 122. As hereinafter described, recess 200 is adapted for receiving torsion spring 180, for reasons hereinafter described.

Referring back to FIG. 6, the collar mechanism 130 includes first and second spaced brackets 132 and 134, respectively. It is intended for first and second spaced brackets 132 and 134, respectively to support pivot pin 160 on which lower support arm 122 is mounted. Brackets 132 and 134 are defined by generally rectangular bases 136 and 138 having generally flat inner surfaces 140 and 142 and outer surfaces 144 and 146. Apertures 148 and 150 extend through base 136 of bracket 132 adjacent opposite ends thereof to facilitate the mounting of bracket 132 to outer surface 53*a* of first leg 53 of a corresponding lower support bracket 52 by means of fastening elements such as bolts, rivets or the like. Base 138 of bracket 134 also includes apertures 164 and 166 therethrough at opposite ends thereof to facilitate the mounting of bracket 134 to outer surface 53*a* of first leg 53 of a corresponding lower support bracket 52 by means of fastening elements such as bolts, rivets or the like. First and second brackets 132 and 134, respectively, are mounted on opposite sides of slot 59 against outer surface 53*a* of first leg 53 of lower support bracket 52 such that lower support arm 122 mounted on pivot pin 160 projects through slot 59.

Bracket 132 further includes a generally cylindrical bearing support 152 projecting from over surface 144 of base 136 and having central aperture 154 therethrough. Aperture 154 through support 152 of bracket 132 is adapted for receiving bearing 156. Bearing 156 rotatably supports first end 158 of pivot pin 160 extending therethrough. Cotter pin 162 extends through first end 158 of pivot pin 160 to retain first end 158 of pivot pin 160 within bearing 156. Similarly, generally cylindrical bearing support 170 projects from outer surface 146 of base 138 and includes an aperture 172 therethrough adapted for receiving bearing 174 therein. Bearing 174 rotatably supports a second end 176 of pivot pin 160. Cotter pin 178 extends through second end 176 of pivot pin 160 so as to retain second end 176 of pivot pin 160 within bearing 174.

Collar mechanism 130 further includes torsion spring 180 having a first end (not shown) fixed to first leg 53 of lower support bracket 52 through block 143 and a second end 182 in engagement with a corresponding lower support arm 122. Torsion spring 180 urges terminal end 194 of lower support arm 122 downwardly, for reasons hereinafter described. In addition, collar mechanism 130 further includes linear spring 184 having a first end engaging bearing support 152 of bracket 132 and a second end engaging first side 186 of a corresponding lower support arm 122. As described, linear spring 184 urges corresponding lower support arm 122 away from bearing support 152 of bracket 132.

Figure 8:
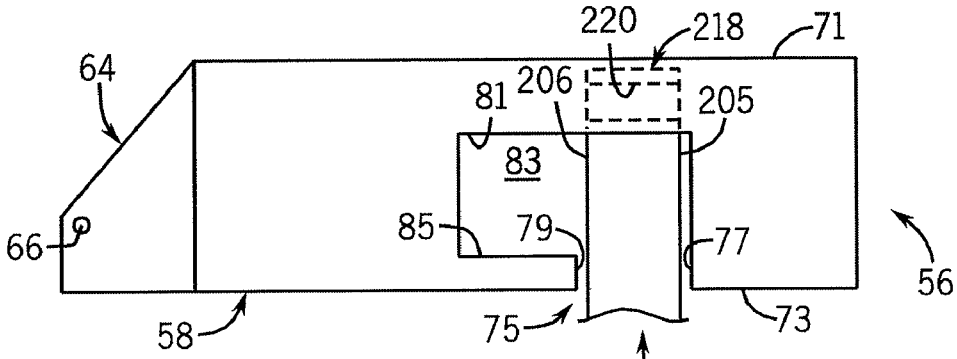
FIG. 8 is a schematic view of an upper support bracket for the ladder accessory of the present invention.

Upper support or base arms 202 are operatively connected to outer surfaces 204 of upper brackets 56 of first and second subframes 48 and 50, respectively, by collar mechanisms 130. Referring to FIGS. 8 and 10, each upper support arm 202 is defined by first and second sides 206 and 208, respectively. First and second sides of 206 and 208, respectively, are interconnected by a generally arcuate outer edge 210 and a generally arcuate inner edge 212. Outer and inner edges 210 and 212, respectively, of upper support arms 202 are interconnected by terminal end 214. Second end 216 of upper support arm 202 includes eye 218 projecting therefrom. Eye 218 includes aperture 220 extending therethrough. Aperture 220 through ear 218 of upper support arm 202 is adapted for receiving pivot pin 160 of corresponding collar mechanism 130 therethrough. Second side 206 of upper support arm 202 includes a recess 222 therein that communicates with aperture 220 through 218 and with inner edge 212 of upper support arm 202. Recess 222 is adapted for receiving torsion spring 180 of collar mechanism 130.

In order to connect an upper support arm 202 to a corresponding upper support bracket 56, upper support arm 202 is mounted on pivot pin 160 of a corresponding collar mechanism 130. The first end of torsion spring 180 is connected to base 58 through block 143 and second end 182 of torsion spring 180 is received in recess 222 and engages upper support arm 202. In addition, the second end of linear spring 184 of collar mechanism 130 engages first side 206 of upper support arm 202. Thereafter, first and second brackets 132 and 134, respectively, are mounted on opposite sides of slot 75 against the outer surface of base 58 of upper support bracket 56 such that upper support arm 202 mounted on pivot pin 160 projects through slot 75.

Figure 5:
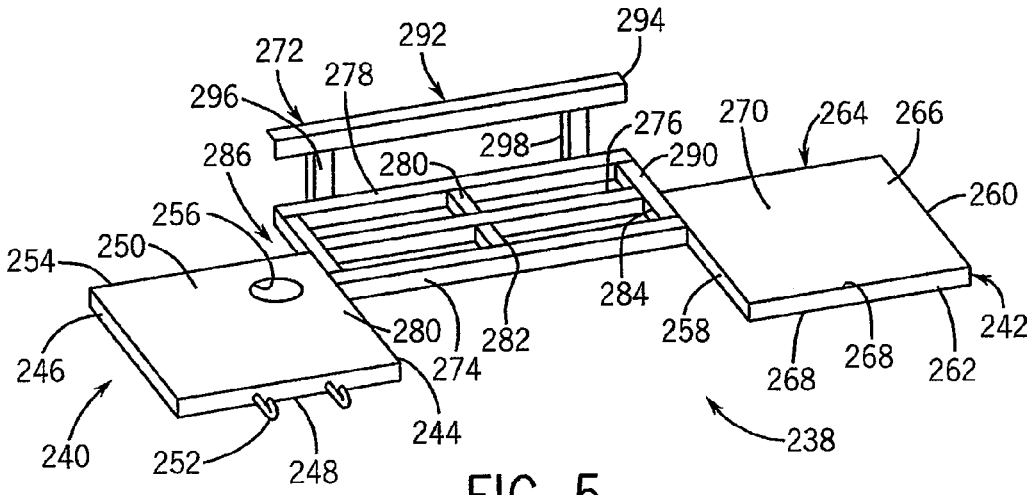
FIG. 5 is an isometric view of a portion of the ladder accessory of the present invention.

In order to assemble ladder accessory 10, first and second subframes 48 and 50 are interconnected by rear frame element 230 having a first end 230*a* interconnected to the outer surface of second leg 54 of lower support bracket 52 of first subframe 48 and a second end 230*b* interconnected to second leg 54 of lower support bracket 52 of second subframe 50, FIG. 2. In addition, first and second subframes 48 and 50, respectively, are interconnected by a tray and supply rack assembly, generally designated by the reference numeral 238, FIG. 5.

Tray and supply rack assembly 238 includes first and second trays 240 and 242, respectively, interconnected to corresponding first and second subframes 48 and 50, respectively, by braces 241 and 243. Tray 240 includes inner edge 244 bonded to upper ends of first and second frame elements 94 and 96, respectively, of first subframe 48 and an outer edge 246. Inner and outer edges 244 and 246, respectively, of tray 240 are interconnected by forward edge 248 and rear edge 250. Forward edge 248 of tray 240 may include a plurality of hooks 252 or the like to allow the user to hang power or hand tools thereon. Upper surface 254 of tray 240 is generally flat and may include a recess 256 therein that may be used to receive cups, nails, screws or the like.

Second tray 242 of tray and supply rack assembly 238 includes an inner edge 258 interconnected to the upper ends of first and second frame element 94 and 96, respectively, of second subframe 50 and an outer edge 260. Inner and outer edges 258 and 260, respectively, of second tray 242 are interconnected by forward and rear edges 262 and 264, respectively. Upper surface 266 of second tray 242 may include a plurality of small holes 264 therein for holding paint brushes, hammers or the like. A circular ring 270 may be formed on upper surface 266 for supporting a paint can therein.

Tray and supply rack assembly 238 further includes supply rack 272 interconnecting first and second trays 240 and 242, respectively. Supply rack 272 includes a plurality of generally parallel frame members 274, 276 and 278, respectively. Frame member 274 extends between inner edges 244 and 258 of first and second trays 240 and 242, respectively, and is interconnected to frame member 276 by a plurality of spaced cross-frame members 282 and 284. Cross frame members 280 and 284 are bonded to corresponding inner edges 244 and 258 of first and second trays 240 and 242, respectively. Frame member 276 is interconnected to frame member 278 by a plurality of cross frame members 286, 288 and 290, respectively. It can be appreciated that frame members 274, 276 and 278 define a shelf for receiving materials such as wood, siding, shingles or the like thereon. A back stop 292 may be provided to maintain materials on frame members 274, 276 and 278. Back stop 292 includes a frame member 294 generally parallel to frame members 274 and 276 and 278 and vertically spaced therefrom. Frame member 294 is interconnected to frame member 278 by first and second vertical supports 296 and 298, respectively. It is contemplated to connect the underside of supply rack 272 to frame element 230 by means of one or more braces 300 to provide strength and stability to supply rack 272, FIGS. 3-4.

In operation, ladder assembly 10 is positioned on base ladder 14 of extension ladder 12, FIG. 11. Lower support arms 122 are pivoted upwardly such that inner surfaces 190 of lower support arms 122 of first and second frame assemblies 48 and 50 engage the outer surfaces 26 of corresponding first and second rails 16 and 18, respectively, of base ladder 14. Upper support arm 202 of first subframe 48 is pivoted upward under the bias of torsion spring 180 such that rail 16 of base ladder 14 is slidably received between first leg 60 of upper support bracket 56 of subframe 48 and second side 206 of upper support arm 202 of first subframe 48. Rail 16 urges upper support arm 202 of subframe 48 first against bias of linear spring 184 into notch 83 in base 58 of upper support bracket 56 so as to prevent upper support arm 202 from pivoting on pivot pin 160 of collar mechanism 130 of first subframe 48. Similarly, upper support arm 202 of second subframe 50 is pivoted upward under the bias of torsion spring 180 such that rail 18 of base ladder 14 is slidably received between first leg 60 of upper support bracket 56 of second subframe 50 and second side 206 of upper support arm 202 of second subframe 50. Rail 18 urges upper support arm 202 of subframe 50 against bias of linear spring 184 into notch 83 in base 58 of a corresponding upper support bracket 56 so as to prevent upper support arm 202 from pivoting on pivot pin 160 of collar mechanism 130 of second subframe 50.

Once ladder accessory 10 is positioned on extension ladder 12, various items such as paint cans, tools, etc. may be positioned on tray and supply rack assembly 238 heretofore described. Thereafter, handle portions 76 of rung lock mechanisms 68 of first and second subframes 48 and 50, respectively, are grasped by a user. The user pivots handle portions 76, and hence, rung lock mechanisms 68 in the first direction toward their unlocked positions. A user may then raise ladder accessory 10 along base ladder 14 of extension ladder 12, as hereinafter described.

As ladder accessory 10 is raised along extension ladder 12, ladder accessory 10 engages the lower end of fly ladder 15, FIG. 12. By moving ladder accessory 10 in a direction away from the urging of rails 16 and 18 against the bias of linear springs 184 of collar mechanisms 130 of first and second subframes 48 and 50, respectively, linear springs 184 of collar mechanisms 130 of first and second subframes 48 and 50, respectively, bias upper support arms 202 from notches 83 into slots 75 thereby allowing upper support arms 202 to pivot on pivot pins 160. As ladder accessory 10 continues to be raised along extension ladder 12, outer edges 210 of upper support arms 202 engage corresponding outer surfaces 42 of rails 32 and 34 of fly ladder 15 and/or brackets 30 so as to urge upper support arms 202 downwardly against the bias of torsion springs 180. As a result, extension ladder 12 is captured between first and second legs 60 and 62 of upper support brackets 56 of first and second subframes 48 and 50, respectively.

As ladder accessory 10 continues to be raised along extension ladder 12, ladder accessory 10 disengages the upper end of base ladder 14, FIG. 13. With ladder accessory disengaged from base ladder 14, lower support arms 122 are free to pivot downwardly under the bias of torsion spring 180 such that rail 32 of fly ladder 15 is slidably received between second leg 62 of upper support bracket 56 of subframe 48 and second side 188 of lower support arm 122 of first subframe 48 and such that rail 34 of fly ladder 15 is slidably received between second leg 62 of upper support bracket 56 of second subframe 50 and second side 188 of lower support arm 122 of second subframe 50.

It can be appreciated that rail 32 of fly ladder 15 urges lower support arm 122 against bias of linear spring 184 into notch 67 in first leg 53 of lower support bracket 52 so as to prevent lower support arm 122 from pivoting on pivot pin 160 of collar mechanism 130 of first subframe 48. Rail 34 of fly ladder 15 urges lower support arm 122 against bias of linear spring 184 into notch 67 in first leg 53 of lower support bracket 52 so as to prevent lower support arm 122 from pivoting on pivot pin 160 of collar mechanism 130 of second subframe 50. Once ladder accessory 10 is raised to a desired position, rung lock mechanisms 68 of first and second subframes 48 and 50, respectively, are released by a user thereby allowing the rung lock mechanisms 68 to pivot in the second direction toward their locking positions such that hooked ends 72 of rung lock mechanisms 68 engage a selected rung 44 of fly ladder 15 for retaining ladder accessory 10 in the desired position.

In order to lower ladder accessory 10, rung lock mechanisms 68 of first and second subframes 48 and 50, respectively, are pivoted by a user in the first direction such that hooked ends 72 of rung lock mechanisms 68 disengage the selected rung 44 of fly ladder 15 thereby allow ladder accessory 10 to be slid downwardly along extension ladder 12. As ladder accessory 10 is lowered along fly ladder 15 of extension ladder 12, ladder accessory 10 engages the upper end of base ladder 14. By moving ladder accessory 10 in a direction away from the urging of rails 16 and 18 against the bias of linear springs 184 of collar mechanisms 130 of first and second subframes 48 and 50, respectively, linear springs 184 of collar mechanisms 130 of first and second subframes 48 and 50, respectively, bias lower support arms 202 from notches 67 into slots 59 thereby allowing lower support arms 122 to pivot on pivot pins 160. As ladder accessory 10 continues to descend along extension ladder 12, inner edges 190 of lower support arms 122 engage corresponding outer surfaces 26 of rails 16 and 18 of base ladder 14 and/or brackets 30 so as to urge lower support arms 122 upwardly against the bias of torsion springs 180. As a result, extension ladder 12 is captured between first and second legs 60 and 62, respectively, of upper support brackets 56 of first and second subframes 48 and 50, respectively.

As ladder accessory 10 continues to be lowered along extension ladder 12, ladder accessory 10 disengages the lower end of fly ladder 15, FIG. 7. With ladder accessory 10 disengaged from fly ladder 15, upper support arm 202 of first subframe 48 is pivoted upward under the bias of torsion spring 180 such that rail 16 of base ladder 14 is slidably received between first leg 60 of upper support bracket 56 of subframe 48 and second side 206 of upper support arm 202 of first subframe 48. Rail 16 urges upper support arm 202 of first subframe 48 against bias of linear spring 184 into notch 83 in base 58 of upper support bracket 56 so as to prevent upper support arm 202 from pivoting on pivot pin 160 of collar mechanism 130 of first subframe 48. Similarly, upper support arm 202 of second subframe 50 is pivoted upward under the bias of torsion spring 180 such that rail 18 of base ladder 14 is slidably received between first leg 60 of upper support bracket 56 of second subframe 50 and second side 206 of upper support arm 202 of second subframe 50. Rail 18 urges upper support arm 202 against bias of linear spring 184 into notch 83 in base 58 of a corresponding upper support bracket 56 so as to prevent upper support arm 202 from pivoting on pivot pin 160 of collar mechanism 130 of second subframe 50. As described, ladder accessory 10 may be slid downwardly along base ladder 14 to the lower end thereof.

Various modes of carrying out the invention are contemplated as being within the scope of the following claims particularly pointing out and distinctly claiming the subject matter, which is regarded as the invention.

We claim:

1. A device for aiding a user in transporting a load up and down a ladder assembly, the ladder assembly including a fly ladder slidably connected to a base ladder, each ladder including first and second spaced rails interconnected by a plurality of spaced rungs, comprising:

a first base leg slideably engageable with a first side of the first rail of the base ladder;

a first base arm pivotable between a first extended position wherein the first base arm is slideably engageable with a second side of the first rail of the base ladder so as to receive the first rail of the base ladder between the first base arm and the first base leg and a second retracted position;

a first fly leg slideably engageable with a first side of the first rail of the fly ladder;

a first fly arm pivotable between a first extended position wherein the first fly arm is slideably engageable with a second side of the first rail of the fly ladder so as to receive the first rail of the fly ladder between the first fly arm and the first fly leg and a second retracted position;

a second base leg slideably engageable with a first side of the second rail of the base ladder;

a second base arm pivotable between a first extended position wherein the second base arm is slideably engageable with a second side of the second rail of the base ladder so as to receive the second rail of the base ladder between the second base arm and the second base leg and a second retracted position;

a second fly leg slideably engageable with a first side of the second rail of the fly ladder; and a second fly arm pivotable between a first extend position wherein the second fly arm is slideably engageable with a second side of the second rail of the fly ladder so as to receive the second rail of the fly ladder between the second fly arm and the second fly leg and a second retracted position.

2. A device for aiding a user in transporting a load up and down a ladder assembly, the ladder assembly including a fly ladder slidably connected to a base ladder, each ladder including first and second spaced rails interconnected by a plurality of spaced rungs, comprising:

a frame assembly including a first subframe positionable adjacent the first rail of the base ladder and a second subframe positionable adjacent the second rail of the base ladder;

a first base leg operatively connected to the first subframe;

a first base arm pivotably connected to the first subframe, the first base arm moveable between a first extended position wherein the first base arm and the first base leg define a first base track for receiving the first rail of the base ladder and a second retracted position;

a first fly leg operatively connected to the first subframe; and a first fly arm pivotably connected to the first subframe, the first fly arm moveable between a first extended position wherein the first fly arm and the first fly leg define a first fly track for receiving the first rail of the fly ladder and a second retracted position;

a second base leg operatively connected to the second subframe;

a second base arm pivotably connected to the second subframe, the second base arm moveable between a first extended position wherein the second base arm and the second base leg define a second base track for receiving the second rail of the base ladder and a second retracted position;

a second fly leg operatively connected to the second subframe; and a second fly arm pivotably connected to the second subframe, the second fly arm moveable between a first extended position wherein the second fly arm and the second fly leg define a second fly track for receiving the second rail of the fly ladder and a second retracted position.

3. A device for aiding a user in transporting a load up and down a ladder assembly, the ladder assembly including a fly ladder slidably connected to a base ladder, each ladder including first and second spaced rails interconnected by a plurality of spaced rungs, comprising:

a frame assembly including a first subframe positionable adjacent the first rail of the base ladder and a second subframe assembly positionable adjacent the second rail of the base ladder;

a first base leg operatively connected to the first subframe;

a first base arm pivotably connected to the first subframe, the first base arm moveable between a first extended position wherein the first base arm and the first base leg define a first base track for receiving the first rail of the base ladder and a second retracted position;

a first fly leg operatively connected to the first subframe;

a first fly arm pivotably connected to the first subframe, the first fly arm moveable between a first extended position wherein the first fly arm and the first fly leg define a first fly track for receiving the first rail of the fly ladder and a second retracted position;

a second base leg operatively connected to the second subframe;

a second base arm pivotably connected to the second subframe, the second base arm moveable between a first extended position wherein the second base arm and the second base leg define a second base track for receiving the second rail of the base ladder and a second retracted position;

a second fly leg operatively connected to the second subframe;

a second fly arm pivotably connected to the second subframe, the second fly arm moveable between a first extended position wherein the second fly arm and the second fly leg define a second fly track for receiving the second rail of the fly ladder and a second retracted position; and a first rung lock mechanism pivotably connected to the first subframe, the first rung lock mechanism movable between a first disengaged position and a second engaged position wherein the first rung lock mechanism engages a user selected rung and prevents the frame assembly from sliding in a downward direction along the ladder assembly.

4. The frame assembly of claim 3 wherein:

the first base arm in the first extended position is adjacent the first rail of the base ladder and wherein the first base arm in the second retracted position is engageable with the first rail of the fly ladder; and the first fly arm in the first extended position is adjacent the first rail of the fly ladder and wherein the first fly arm in the second retracted position is engageable with the first rail of the base ladder.

5. The frame assembly of claim 3 further comprising a second rung lock mechanism pivotably connected to the second subframe, the second rung lock mechanism being movable between a first disengaged position and a second engaged position wherein the second rung lock mechanism engages a user selected rung and prevents the frame assembly from sliding in a downward direction along the ladder assembly.

6. The frame assembly of claim 3 wherein:

the first base arm is positioned between the first base leg and the first fly arm; and the first fly arm is positioned between the first fly leg and the first base arm.

7. The frame assembly of claim 6 wherein:

the second base arm is positioned between the second base leg and the second fly arm; and the second fly arm is positioned between the second fly leg and second base arm.

8. The device of claim 3 further comprising a tray operatively connected to the frame assembly, the tray lying in a generally horizontal plane.

9. A device for aiding a user in transporting a load up and down a ladder assembly, the ladder assembly including a fly ladder slidably connected to a base ladder, each ladder including first and second spaced rails interconnected by a plurality of spaced rungs, comprising:

a first base leg slideably engageable with a first side of the first rail of the base ladder;

a first base arm pivotable between a first extended position wherein the first base arm is slideably engageable with a second side of the first rail of the base ladder so as to receive the first rail of the base ladder between the first base arm and the first base leg and a second retracted position;

a first fly leg slideably engageable with a first side of the first rail of the fly ladder; and a first fly arm pivotable between a first extended position wherein the first fly arm is slideably engageable with a second side of the first rail of the fly ladder so as to receive the first rail of the fly ladder between the first fly arm and the first fly leg and a second retracted position;

wherein the first base arm is positioned between the first base leg and the first fly arm.

10. The device of claim 9 further comprising a rung lock mechanism, the rung lock mechanism movable between a first disengaged position wherein the first base leg, the first base arm, the first fly leg and the first fly arm are free to slide in a downward direction and a second engaged position wherein the rung lock mechanism engages a user desired rung for preventing first base leg, the first base arm, the first fly leg and the first fly arm from sliding in a downward direction.

11. The device of claim 9 further comprising a support frame for supporting the first base leg, the first base arm, the first fly leg and the first fly arm.

12. The device of claim 11 further comprising a tray operatively connected to the support frame, the tray lying in a generally horizontal plane.

13. The device of claim 9 wherein the first base arm in the first extended position is adjacent the second side of the first rail of the base ladder and wherein the first base arm in the second retracted position is engageable with the first rail of the fly ladder.

14. The device of claim 9 wherein the first fly arm in the first extended position is adjacent the second side of the first rail of the fly ladder and wherein the first fly arm in the second retracted position is engageable with the first rail of the base ladder.

15. A device for aiding a user in transporting a load up and down a ladder assembly, the ladder assembly including a fly ladder slidably connected to a base ladder, each ladder including first and second spaced rails interconnected by a plurality of spaced rungs, comprising:

a first base leg slideably engageable with a first side of the first rail of the base ladder;

a first base arm pivotable between a first extended position wherein the first base arm is slideably engageable with a second side of the first rail of the base ladder so as to receive the first rail of the base ladder between the first base arm and the first base leg and a second retracted position;

a first fly leg slideably engageable with a first side of the first rail of the fly ladder;

a first fly arm pivotable between a first extended position wherein the first fly arm is slideably engageable with a second side of the first rail of the fly ladder so as to receive the first rail of the fly ladder between the first fly arm and the first fly leg and a second retracted position;

wherein the first fly arm is positioned between the first fly leg and the first base arm.

16. A device for aiding a user in transporting a load up and down a ladder assembly, the ladder assembly including a fly ladder slidably connected to a base ladder, each ladder including first and second spaced rails interconnected by a plurality of spaced rungs, comprising:

a frame assembly including a first subframe positionable adjacent the first rail of the base ladder and a second subframe positionable adjacent the second rail of the base ladder;

a first base leg operatively connected to the first subframe;

a first base arm pivotably connected to the first subframe, the first base arm moveable between a first extended position wherein the first base arm and the first base leg define a first base track for receiving the first rail of the base ladder and a second retracted position;

a first fly leg operatively connected to the first subframe; and a first fly arm pivotably connected to the first subframe, the first fly arm moveable between a first extended position wherein the first fly arm and the first fly leg define a first fly track for receiving the first rail of the fly ladder and a second retracted position;

wherein the first base arm is positioned between the first base leg and the first fly arm.

17. The device of claim 16 further comprising a rung lock mechanism pivotably connected to at least one of the first and second subframes, the rung lock mechanism movable between a first disengaged position and a second engaged position wherein the rung lock mechanism engages a user selected rung and prevents the frame assembly from sliding in a downward direction along the ladder assembly.

18. The device of claim 16 further comprising a tray operatively connected to the frame assembly, the tray lying in a generally horizontal plane.

19. The frame assembly of claim 16 wherein the first base arm in the first extended position is adjacent the first rail of the base ladder and wherein the first base arm in the second retracted position is engageable with the first rail of the fly ladder.

20. The frame assembly of claim 16 wherein the first fly arm in the first extended position is adjacent the first rail of the fly ladder and wherein the first fly arm in the second retracted position is engageable with the first rail of the base ladder.

21. A device for aiding a user in transporting a load up and down a ladder assembly, the ladder assembly including a fly ladder slidably connected to a base ladder, each ladder including first and second spaced rails interconnected by a plurality of spaced rungs, comprising:

a frame assembly including a first subframe positionable adjacent the first rail of the base ladder and a second subframe positionable adjacent the second rail of the base ladder;

a first base leg operatively connected to the first subframe;

a first base arm pivotably connected to the first subframe, the first base arm moveable between a first extended position wherein the first base arm and the first base leg define a first base track for receiving the first rail of the base ladder and a second retracted position;

a first fly leg operatively connected to the first subframe; and a first fly arm pivotably connected to the first subframe, the first fly arm moveable between a first extended position wherein the first fly arm and the first fly leg define a first fly track for receiving the first rail of the fly ladder and a second retracted position;

wherein the first fly arm is positioned between the first fly leg and the first base arm.

* * * * *